US008303473B2

(12) United States Patent
Gutierrez et al.

(10) Patent No.: US 8,303,473 B2
(45) Date of Patent: Nov. 6, 2012

(54) MULTI-SPORT ATHLETIC TRAINING APPARATUS AND METHOD

(76) Inventors: Daniel V. Gutierrez, San Pedro, CA (US); Roni R. Gutierrez, San Pedro, CA (US); Stephen L. Gutierrez, San Clemente, CA (US)

( * ) Notice: Subject to any disclaimer, the term of this patent is extended or adjusted under 35 U.S.C. 154(b) by 203 days.

(21) Appl. No.: 12/857,558

(22) Filed: Aug. 17, 2010

(65) Prior Publication Data

US 2011/0045954 A1 Feb. 24, 2011

Related U.S. Application Data

(60) Provisional application No. 61/274,558, filed on Aug. 19, 2009.

(51) Int. Cl.
*A63B 21/02* (2006.01)
*A63B 21/04* (2006.01)

(52) U.S. Cl. ..... 482/121; 482/124; 482/126

(58) Field of Classification Search ..... 482/51, 482/54, 121–139
See application file for complete search history.

(56) References Cited

U.S. PATENT DOCUMENTS 3,519,269 A * 7/1970 Howlett et al. ..... 482/120
5,472,394 A * 12/1995 Michaelson ..... 482/74
5,549,532 A * 8/1996 Kropp ..... 482/126
5,951,443 A * 9/1999 Askins ..... 482/74
6,840,894 B2 * 1/2005 Lerner ..... 482/124
7,147,590 B2 * 12/2006 Toven ..... 482/51
7,361,127 B2 * 4/2008 Tremayne ..... 482/130
7,608,015 B2 * 10/2009 Radow ..... 482/4
2003/0220160 A1 * 11/2003 Clark et al. ..... 473/446
2007/0142185 A1 * 6/2007 Woodman et al. ..... 482/69
2009/0098945 A1 * 4/2009 George ..... 473/213
2009/0291780 A1 * 11/2009 Gutierrez ..... 473/426
2010/0062881 A1 * 3/2010 Horkan ..... 473/439
2010/0216613 A1 * 8/2010 Pacini ..... 482/122
2011/0207585 A1 * 8/2011 Burns ..... 482/124

* cited by examiner

*Primary Examiner* — Stephen Crow
(74) *Attorney, Agent, or Firm* — Law Office of Robert E. Kasody, P.C.

(57) ABSTRACT

An athletic training apparatus to assist a coach training muscle coordination of a player. An adjustable, delayed resistance, burst release, extension coil operatively couples to a first cable harness and a second cable harness. The first cable harness detachably couples to a coach and feedbacks real-time physical movements of the coach to the player. The second cable harness detachably couples to a training muscle group of the player. The training muscle group receives feedback from the real-time physical movements of the coach including a first resistance level during one portion of the exercise routine and a second resistance level during a second portion of an exercise routine. During an exercise routine, movements of the player are substantially unaffected and unstrained by the athletic training apparatus.

16 Claims, 4 Drawing Sheets

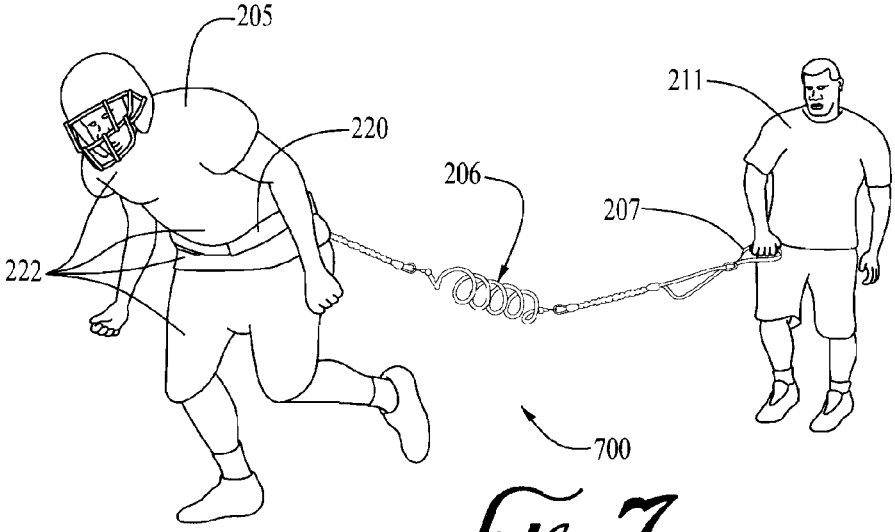
FIG. 7
800
FIG. 8
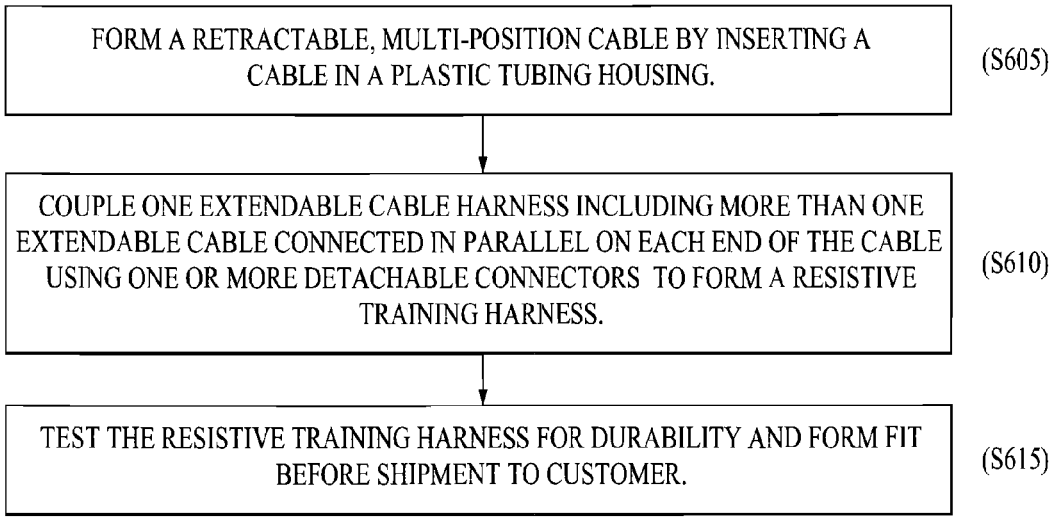

MULTI-SPORT ATHLETIC TRAINING APPARATUS AND METHOD

PRIORITY AND RELATED APPLICATION(S)

This non-provisional US utility patent application incorporates by reference in its entirety and claims priority to filed U.S. provisional patent application entitled "Mule Coil (UPROZtm)" filed on Aug. 19, 2009, with Application No. 61/274,558.

BACKGROUND OF THE INVENTION

1. Field of the Invention

The invention relates generally to the field of sports equipment and training systems, and specifically in one exemplary aspect to a resistance training apparatus employing coiled resistance for athletic training involving a coach and a player or athlete.

2. Description of Related Technology

Athletic training processes, both apparatuses and methodologies, are well known in the art. Athletic training processes, such as related to resistance training provide a method for improving athletic ability during a simulated exercise routine. For instance, FIG. 1 illustrates one type of conventional athletic resistance trainer 100 involving both coach 102 and player 104 to improve strength and endurance of player 104. In this system, player 104 attaches to nylon strap 106 of trainer 100, coach 102 grabs handle 105 attached to nylon strap 108, and player 104 directs coach 102 through one or more training exercises. Another type of conventional athletic resistance trainer (not shown) involves attachment of wrist, ankle, arm, barbells, or other weighted devices to a player. Continuing with this trainer example, player learns how to perform a desired athletic move so that during regulation play, when the weights are removed, the player may perform better because of training with increased resistance.

However, there are still needed an improved resistance system and apparatus that permits easy initial configuring and reconfiguring, i.e., multiple adaptive learning, muscle isolation training, strength training, speed training, and agility, to improve athletic agility and quickness, which minimizes required labor and/or time from initial athletic screening by a coach. Such improved apparatus and methods would ideally minimize labor-intensive tasks of adjustment and/or installation of apparatuses and structures. Furthermore, it would be advantageous for an improved process or system to provide multiple configurations, and thus permit the creation of customized training configurations and minimally evasive processes using one or more structures or components. In addition, the improved process or system would assist in directed and real-time training of players and athletes alike by one or more coaches and thereby potentially increase strength and endurance of a player in a non-invasive, non-injury manner.

SUMMARY OF THE INVENTION

In one aspect of the present invention, a sports resistance coach assisted training apparatus is disclosed. More specifically, the disclosed resistance trainer provides a system for athletes to increase their speed, agility, and power. In one embodiment, an athletic training apparatus is disclosed to assist a coach training muscle coordination of a player during an exercise routine. In operation, a burst release, multi-resistance cable (e.g., adjustable, delayed resistance, burst release, extension coil) operatively couples on a first end to a first end of a first cable harness and on a second end to a first end of a second cable harness. A second end of the first cable harness detachably couples to a coach and feedbacks and feeds-forward real-time physical movements of the coach to the player. A second end of the second cable harness detachably couples to a training muscle group of the player. During an exercise routine, the training muscle group receives feedback from the real-time physical movements of the coach comprising an initial resistance level during one portion of the exercise routine and an altered resistance level during a second portion of the exercise routine. During an exercise routine, movements of the player are substantially independent during duration of the exercise routine.

Advantageously, the system of the present invention trains an athlete with resistance and with minimal impedance to actual mechanics of muscle movement. In one variant, the system provides a tailored transition resistance to athletes. In one example, the tailored transition resistance promotes recruitment of explosive muscle fibers. Upon removal of resistance from a particular movement of an athlete, muscle fibers explode to overcome the phantom resistance applied by the system.

Furthermore, repetitive training with the system will result in improved first-step explosion, and balance, as well as develop the athletes overall playing speed, including acceleration, deceleration, change of direction and sprinting.

Thus, the system of the present invention promotes training of resistive speed controlled by player's or athlete's brain and nervous system. As such, the brain and nervous system are conditioned to handle quicker movements with added resistance. As such, system may be used for linear, lateral, diagonal, and vertical training, with minimal risk of injury to a player or athlete.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

FIG. 7 is a schematic of a coach and a player utilizing the resistance trainer of FIG. 2 during a football exercise routine in accordance with an embodiment of the present invention.

FIG. 8 is a method for forming a resistance trainer in accordance with an embodiment of the present invention.

DETAILED DESCRIPTION

Figure 1:
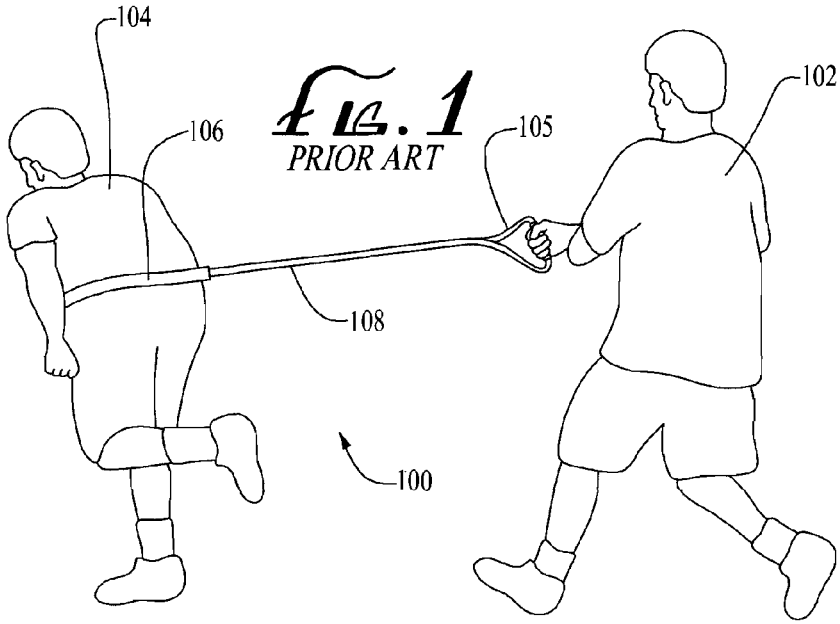
FIG. 1 PRIOR ART
FIG. 1 is a schematic of a conventional resistance trainer containing a nylon strap to provide resistance training of an athlete.

Reference is now made to the drawings wherein like numerals refer to like parts throughout.

Overview

In one salient aspect, the present invention discloses apparatuses and methods for improving strength and endurance related to, inter alia, athletics including professional sports players. In particular, the present invention discloses an apparatus and method configurable to assist a coach in evaluating and improving strength and muscle coordination of a player for initiating and providing positive reinforcement of one or more muscle coordination or training exercises. Furthermore, the present invention further discloses a technique for smoothly improving athletic ability in real-time, with minimal opportunity for injury to player. In addition, the apparatus allows a more intuitive method to synchronize explosive muscle power release and brain and eye coordination while performing an exercise routine.

For instance, the apparatus provides increased player and coach body communication and synchronized motion during player motions including: fielding an in-field baseball, sprinting during football practice, hand and eye coordination during a boxing training session, stoke used during a golf practice, abdominal, waist, back and Pec development necessary for deep-sea scuba diving or underwater swimming, and the like. As such, the apparatus thereby allows a player's brain to more intuitively distinguish signals of athletic motion or exercise directly, to improve a player's physical motion characteristics.

In addition, the apparatus advantageously provides the ability to taper a level of resistance to a particular player, synchronize, and absorb shock on a player during an exercise routine for one or more muscle groups and muscle fibers thereof while minimally affecting or influencing a player's movements during the exercise routine.

Advantageously, in one embodiment, an adjustable resistance coil has an inner coil (e.g., a chosen level resistance bungee cord) that improves absorption of shock and pull on a training muscle group of a player while a player is running during an exercise routine (resistance training posing). In one variant, an adjustable resistance coil has an outer polyurethane or rubber/plastic tubing adjusted with different size inner and outer diameter to adjust for level of resistance training and/or weight of a player and maintain, for instance, an inner bungee cord and/or outer bungee cord in sync with each other and the outer tubing. Advantageously, in one embodiment, the system improves a coach's ability to manage and direct a player's movements to improve muscular coordination (e.g., improve in-fielding or sprinting capability of a player under "load conditions" (e.g., resistance conditions)) while having one or more adjustable, recoil resistance level(s) applied to a player during an exercise routine that could not otherwise be seen using many conventional resistance training apparatuses. Furthermore, a coach may unobtrusively view one or more exercise routines of one embodiment and a player's movements during an exercise routine are minimally affected.

Exemplary Apparatus, System, and Method

Referring to FIGS. 2-10, exemplary embodiments of the apparatus, system, and methods of the invention are described in detail. It will be appreciated that while described primarily in the context of an athletic training system and apparatus, e.g., the system strengths and conditions of training muscle group for amateurs, weekend athletics, semi-professionals, and professionals. For instance, even though this description discloses uses of the invention for athletic positioning, pre-positioning, timing drills, and burst release modes for an athletic activity, there are at least portions of the apparatus and other methodology of the apparatus, system, and methodology described herein that may be used for other applications or purposes.

For example, it will be recognized that the present invention may used to rehabilitate injured persons for instance recovering from a car accident, recent surgery patients including knee, leg, ankle, arm, hand, and in general weak or frail muscled individuals desiring to improve their strength and endurance level in one or more muscle groups. Other functionality or applications of the present invention may include assistance in aging and handicapped individuals that desire to improve their quality of life and generally degree of freedom of movement, agility and the like. As such, a myriad other functions will be recognized by those of ordinary skill given the present disclosure.

Figure 2:
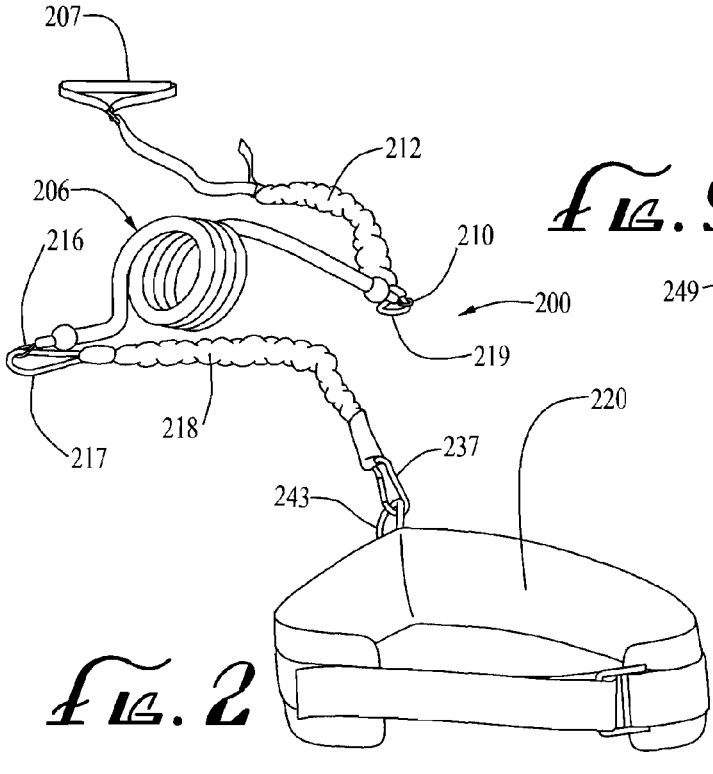
FIG. 2 is a schematic of a resistance trainer having a wishbone shaped harness for player, a resistive coil to improve explosive player energy, a first cable harness, and a second cable harness for improving resistance training for a targeted muscle group in accordance with an embodiment of the present invention.
Figure 9:
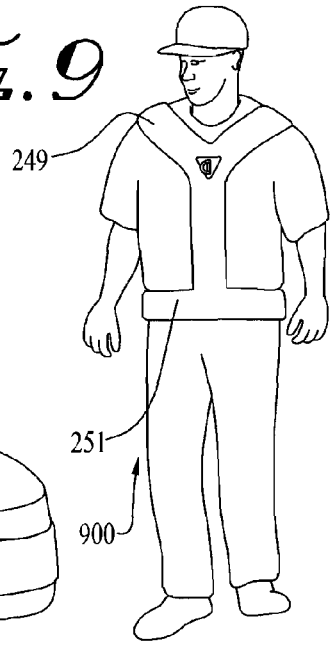
FIG. 9 is a schematic illustrating a chest harness that replaces the wishbone shaped harness of FIG. 2 in accordance with an embodiment of the present invention.

Referring to FIG. 2, athletic system 200 (system) is disclosed that assists coach (e.g., coach 202, 211) training muscle coordination of player (e.g., player 204, 205) during an exercise routine (e.g., track 50 yard dash drill, football linebacker drill, baseball in-field, out-field drill, or the like). Adjustable, delayed resistance, burst release, extension coil 206 operatively couples on first coil end 208 having a steel braided loop 241 to first end 210, for instance, using D Stainless Clip and Steel Ring 219, attached, for instance, by glue or stitching (e.g., stitching 238) to leather material, of first cable harness 212. Coil 206 having a steel braided loop 246 on a second coil end 214 connects to first end 216, for instance, using D Stainless Clip and Steel Ring 217, of second cable harness 218. In one embodiment, adjustable, delayed resistance, burst release extension coil 206 includes inner diameter cable 228 and outer diameter tube 230. In one embodiment, D Stainless Clip and Steel Ring 217 include 2" welded steel D-ring zinc coated with tensile strength in a range of 200 to 600 lbs, with a preferred embodiment including approximately 5000 lbs breaking strength.

In one embodiment, system 200 includes an inner diameter cable 228 that includes a coiled steel or metal cable that measures, for instance, in a range of ¼ to ¾ of an inch in diameter, with cable stops 233, 234, e.g., nylon ball stops, at each end thereof In one embodiment, outer diameter tube 230 includes hollow plastic tube, for instance, with an inner diameter that approximately mates with outer surface of inner diameter cable 228. In one variant, outer diameter tube 230 has a wall thickness in a range of ⅛ to ½ of an inch that couples and encloses inner diameter cable 228. In yet another variant, inner diameter cable 228 includes a bungee cord enclosed by a plastic covering, e.g., polyurethane coiled tube. In one embodiment, outer diameter tube 230 includes an outer plastic covering coiled tube. In one example, inner diameter cable 228 includes a 7 inch×19 inch stainless steel cable, type 304, having a diameter of 5/32 inch with an approximate breaking strength of 2,400 lbs.

In one variant of the above embodiment, each end is equipped with nylon ball stops 233, 234 (e.g., range of ⅛ to ½" diameter with a preferred embodiment having a ¼" diameter) having a breaking strength, for instance, approximately in the 1,000 to 2,400 lbs range. In another variant, the inner diameter cable 228 includes between 3 to 5 coil wraps with two tail and/or lead ends and outer diameter tube includes a polyurethane coiled tube. In yet another variant, inner diameter cable 228 stretches from a static position (no load or resistance condition) within a range of 6 to 20 inches to an elongated range (high load resistance of 100 lbs) between length of 3 foot to 9 foot. As such, inner and outer diameter cables 228, 230 combined to provide a smooth resistance from static (zero) to high resistance (e.g., 100 lbs) with minimal coach (e.g., trainer) movement (in one embodiment) and small fractional coach (e.g., trainer) movement (in another embodiment) relative to an amount of applied resistance to player.

Figures 3, 10:
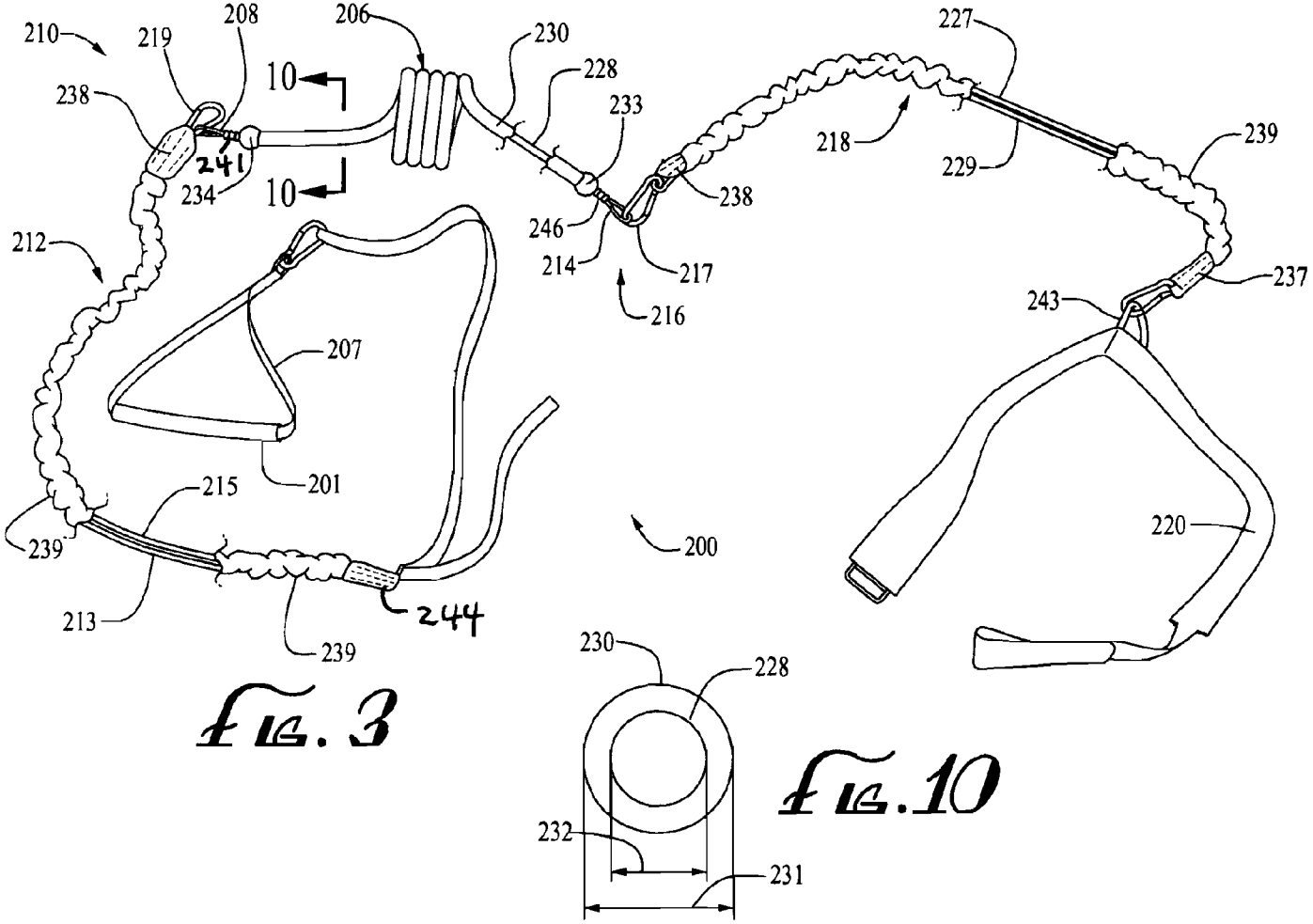
FIG. 3 is a schematic of the resistance trainer of FIG. 2 illustrating cut-away views of first and second cable harness to illustrate multiple cable structure and cut-away views of coil illustrating inner and outer diameter cables in accordance with an embodiment of the present invention.
FIG. 10 is a schematic diagram illustrating a cross-sectional view (10-10) of a diameter of an inner cable and outer diameter tube of the resistance trainer of FIG. 3 in accordance with an embodiment of the present invention.

Advantageous, as compared to conventional strapped athletic training equipment, the present invention provides coiled, delayed resistance training so that a smoother transition in a change in resistance level, e.g., reducing or eliminating a jerk or strain, between one resistance level and another resistance level. In one variant, first resistance level, e.g., illustrated in FIG. 4, includes non-engaged resistance level, zero resistance level, and player begins process for assuming a particular athletic motion. In another variant, another resistance level, e.g., illustrated in FIG. 5, includes a burst mode, 15 lb resistive level, and first player ready mode for a particular athletic position. In one variant, another resistance level, e.g. illustrated in FIG. 6, includes a burst mode, 40 lb resistive level, and second player ready mode for a particular athletic position. In one variant, inner diameter cable 228 and outer diameter tube 230 uncoil to adjust a level of resistance that player 204 receives during an exercise routine. In yet another embodiment, diameter 232 of inner diameter cable 228 and diameter 231 of outer diameter tube 230 controls level of resistance applied to training muscle group 222 of player (e.g., player 204, 205). As illustrated in FIG. 10, a ratio of inner diameter 232 to outer diameter 231 controls level of applied trainer resistance to player. In a first example (Example A), smaller inner diameter 232 corresponds to less available resistance and larger diameter 231 (e.g., larger diameter difference as compared to small inner diameter 232) corresponds to higher level of control of movement (e.g., less stiffness and increased flexibility of resistive trainer 200 as compared to Example B discussed supra. In a second example (Example B), a larger inner diameter 232 corresponds to higher available resistance and smaller diameter 231 (e.g., smaller diameter difference as compared to larger inner diameter 232) corresponds to a lower level of control of movement (e.g., increased stiffness and/or less flexibility of resistive trainer 200 as compared to Example A).

Advantageously, when training, player (e.g., athlete 204, 205) to increase speed, agility, and power, system 200 trains a player with resistance but minimally impedes actual mechanics of player's muscle movements. Furthermore, as compared to many conventional resistance systems, system 200 provides a tailored transition resistance to players and athletes by having adjustable coil 206 (e.g., multi-level, tension cable) and adjustable cable harnesses 212, 218 (each having tension resistance adjustable cabling tailored to desired tension, flexibility, twisting, explosive release properties, and the like). For instance, tailored transition resistance promotes recruitment of explosive muscle fiber growth and development that are part of training muscle group 222. Upon removal of a level of resistance from a particular movement of an athlete, muscle fibers explode overcoming the phantom resistance (resistance level) applied by system 200. Advantageously, repetitive training with system 200 results in improved first-step explosion, and balance, as well as develop a player's (e.g., athletes) overall playing speed, including acceleration, deceleration, change of direction and sprinting.

As illustrated in FIGS. 3-7, coach 202 deattachably couples to (e.g., grasps, holds, or the like) second end, e.g., canvas loop 207, of first cable harness 212 to feedback real-time physical movements of coach (e.g., coach 202, 211) to player (e.g., player 204, 205) during an exercise routine. In one instance, canvas loop 207 includes approximately ¼ inch to 1 inch polyurethane trainer grip 201, where canvas loop 207 are secured, e.g. sewn with 138 ultra poly 16 oz. thread, with snap hooks to first cable harness 112. In one variant, snap hooks include 3 inch snap hooks 316 made of stainless steel and having tensile strength tested up to approximately 400 lbs. Player (e.g., player 204, 206) deattachably couples to second end, e.g., wrap around Velcro wishbone shaped harness 220, of second cable harness 218 to train muscle group 222 (e.g., waist, lower abdominal region, thighs, calves . . . ) receives feedback from real-time physical movements of coach (e.g., coach 202, 211). In one variant, wishbone shaped harness 220 has on second end D-shaped ring clip 217, 219, e.g., 2" welded steel D-ring tested to a tensile strength of minimum of 400 lbs, sewn, e.g., a using 138 ultra poly 16 oz thread, to wishbone shaped harness 220. In one variant, wishbone shaped harness 220 attaches around training muscle group 222, e.g., waist of player (e.g., player 204, 205), using fasteners, e.g., hook and loop fasteners such as 2" wide and with steel adapter, to quick connect and disconnect functionality of coil 206 with player (e.g., player 204, 205).

Figure 4:
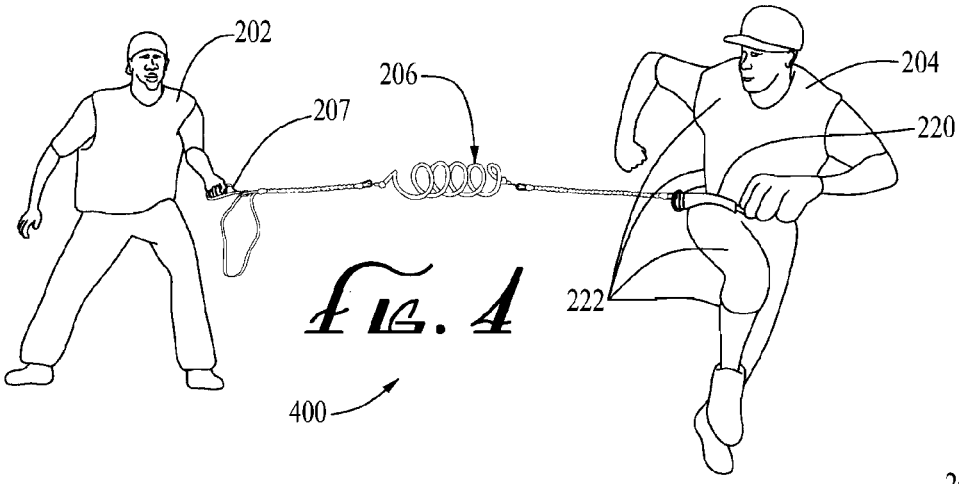
FIG. 4 is a schematic of a coach and a player utilizing an initial resistance level of the resistance trainer of FIG. 2 during a baseball exercise training routine in accordance with an embodiment of the present invention.
Figure 5:
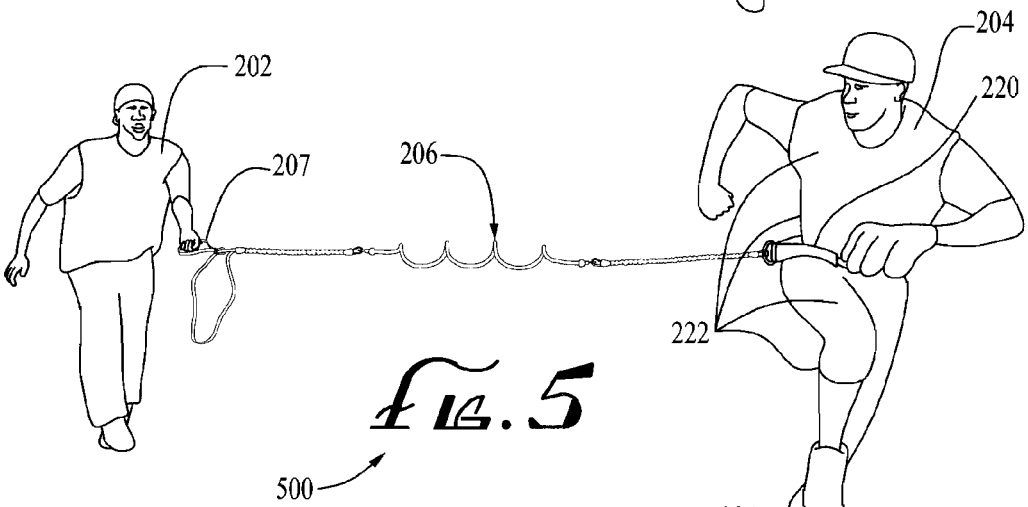
FIG. 5 is a schematic of a coach and a player utilizing another resistance level of the resistance trainer of FIG. 2 during a baseball exercise training routine in accordance with an embodiment of the present invention.

As best illustrated in FIG. 4, system 200 applies a first resistance level (e.g., coil 206 in low resistance position) to player (e.g., player 204, 205) from coach (e.g., coach 202, 211) during a portion of exercise routine. In one embodiment and referring again to FIG. 4, in one portion of exercise routine, player 204 accelerates from stop and a level of resistance is minimal applied by system 200 on player 204 from coach 202. As illustrated in FIG. 5, another resistance level (e.g., coil 206 in medium resistance position) being applied by system 200 to player 204 by coach 202 during a second portion of an exercise routine. In one embodiment and referring again to FIG. 5, in a second portion of exercise routine, player 204 accelerates to an athletic position (e.g. second base catch position) and increased level of resistance is higher than minimum, which increased resistance level is combined effort of, for instance, coil 206, cable harnesses 212, 218, and coach (e.g., coach 202, 211) on player (e.g., player 204, 205). Advantageously, as compared to many conventional athletic training apparatuses, coil 206 of system 200 provides a graduated multi-level of resistance (increasing, decreasing) smoothly transferable to player (e.g., player 204, 205) during exercise routine so that movements of player (e.g., player 204, 205) are substantially independent (e.g., true to form) of a chosen/selected level of resistance during duration of exercise routine.

Advantageously, as compared to many conventional athletic systems having only two levels of resistance (minimal, maximum), system 200 provides for a multi-level resistance transfer (e.g., coil 206 unravels or uncoils to achieve smooth, resistance changes; tension cables 213, 215, 227, 229 unravel, rotates, and twist) between coach's movements or directionality and those of player. Thus, real-time movements (muscle directionality) by coach (e.g., coach 202, 211) transfers directly to player (e.g., player 204, 206) with minimal step in applied force or resistance. Thus, system 200 provides and creates a no jerk, buffered delta resistance change on training muscle group 222 as player (e.g., player 204, 205) changes directions, orientations, positioning, or stature to train sub-muscle groups as well as overall training muscle group 222.

For instance, sub-muscle groups may include lower abdomen, upper abdomen, Pecs, lateral muscles, thighs that may be part of training muscle group 222. As such, system 200 promotes development of resistive speed (e.g., explosive, directional muscle group movements) controlled by a player's (e.g., athletes) brain and nervous system. System 200 conditions both brain and nervous system of player (e.g., player 204, 205) to handle quicker movements with added resistance. As such, system 200 provides player (e.g., player 204, 205) and coach (e.g., coach 202, 211) an ultimate tool that assists player to become an athlete, improve athletic ability, or achieve fitness personal goals.

Consequently, system 200 provides training muscle group 222 with minimal stress, strain, or injury during an exercise routine as compared to conventional two resistance level trainers that create a jerk condition when player reaches a maximum resistance level. Furthermore, system 200 provides advantages over other conventional trainers having one fixed resistance level attached to one or more muscle groups (dumbbells, free weights, angle weights, arm weights, and the like) which may initially stain muscles when a player moves from a starting position, ready exercise, or actual participation in an exercise routine.

Figure 6:
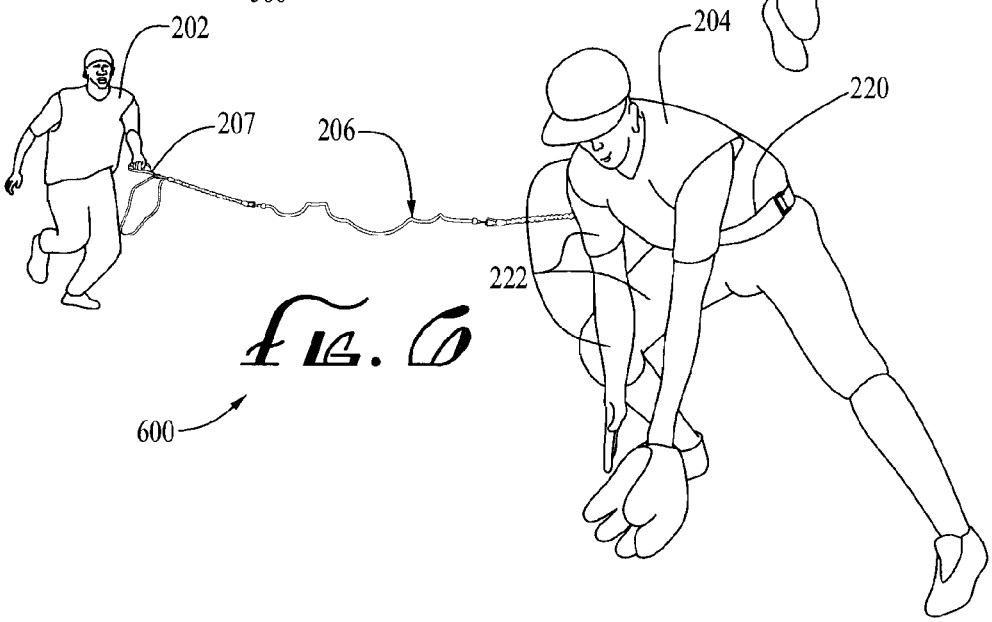
FIG. 6 is a schematic of a coach and a player utilizing yet another resistance level for the resistance trainer of FIG. 2 during a baseball exercise training routine in accordance with an embodiment of the present invention.

As best illustrated in FIG. 4, a first portion of exercise routine includes player 204 commences motions to achieve a burst mode athletic position. Referring to FIGS. 5 and 6, a second portion of exercise routine includes player 204 strives toward completion of burst athletic position. In yet another embodiment, first and second cable harnesses 212, 218 (e.g., tethers or tethering) include inner and outer tension cables (bungee cables 213, 215, 227, 229) crimped together to absorb shock to training muscle group 222 during a transitioning period between first portion and second portion of exercise routine. In yet another embodiment, first and second cable harnesses 212, 218 including inner and outer tension cables (bungee cables 213, 214, 227, 229) may be braided or tied together along one or more cabling positions. In one variant, first and the second cable harnesses 212, 218 each comprise two tension cables (bungee cables 213, 214, 227, 229) to absorb shock to training muscle group 222 of player (e.g., player 204, 205) during a transition period between portions (e.g., first and second portions) of exercise routine. Advantageously, as compared to many conventional resistance training systems, system 200 in real-time utilizes its inner and outer tension cables 213, 214, 227, 229 to continuous adjust level of resistance and twisting force applied to player (e.g., player 204, 205).

In another embodiment, second end 243 of second cable harness 218 (e.g., second tethering) includes a wishbone shape harness 220 that attaches and conformal fits, e.g., wraps around, waist or lower abdomen region of player (e.g., player 204, 205). Using harness 220, player (e.g., player 204, 205) receives real-time resistance train strength and endurance when performing multiple changes in direction of motion. In one variant, second end 243 of second cable harness 218 replaces wishbone shaped harness 220 with chest and waist harness 249, 251 (see FIG. 9) that attaches to second end 243. Continuing with this embodiment, conformal fitting chest and waist harness 249, 251 may be fit to a player during exercise routine to increase and add more uniformly distributed force resistance in real-time to train player to perform changes in direction of motion from, for instance, an initial direction to an athletic position. In one variant, inner and the outer tension cables (e.g., bungee cables 213, 215, 227, 229) include at least one of two different tension resistance values (e.g. expansion coefficient) and different outer diameter physical dimensions (e.g. one may have ⅜ inch diameter and other ¼ of an inch diameter).

In another variant, stretch, tubular, nylon or polypropylene webbing 239 (e.g., two "2" inch diameter tubular webbing) encloses inner and outer tension cables 227, 229 to provide for stretching and expanding of second cable harness 218. In one example, nylon webbing 239 may be chosen from a range of approximately 1" to 3" diameter that provides break strength approximately 5,600 lbs. In one variant, nylon webbing 239 is sewn together using polyester thread, e.g., stitches 238, 237, 244, include 138 ultra poly 16 oz. thread and encased fabric selected from a range of ¼" to ⅜" of an inch. In one variant of the present example, nylon webbing 239 has pull rating strength from zero (non-elongated) to approximately 40 lbs (elongated). In one variant, nylon webbing 239 has pull range from approximately 24" to 48". In another variant, stretch, crunch nylon webbing 239 stretches from seven "7" foot in compacted position to eighteen "18" foot when fully expanded.

In another embodiment, adjustable, delayed resistance, burst release coil 206 comprises an adjustable tension cable enclosed by plastic coiled tube to absorb shock while player (e.g., player 204, 205) performs first portion or second portion of an exercise routine. In yet another variant, first and the second cable harnesses 212, 218 include each two bungee cords (213, 215, 227, 229) of varying, recoil tension coefficients coiled or crimped together and housed in a retractable nylon sleeve (e.g., nylon webbing 239).

Advantageously, system 200 may be used to training one or more muscle groups to improve linear, lateral, diagonal, and vertical training, without the risk of injury to player (e.g., athlete). In one embodiment, system has a resistance capacity of 2,400 lbs and its 20% safe working load is 480 lbs. As such, system 200 provides a safe training system to improve an athlete's speed, agility and power. Accordingly, system 200 permits both flexion and extension of one or more muscle groups and muscle fibers (e.g., sub-muscle groups) without causing direct impact upon engagement and/or disengagement of player (e.g., athlete) or coach (e.g., trainer) during an exercise routine. Thus, system 200 provides a smooth increase of resistance, which develops player (e.g., athlete) balance, game speed, quickness and power (e.g., promotes development of quick twitch muscle fiber(s) and muscle memory) for a wide variety of sports, e.g., baseball, basketball, boxing, football, and the like.) for all age groups (e.g., children, youths, young adults, adults, semi-professional and professional sports players (e.g., NFL) and the like).

Referring to FIG. 8, a method is disclosed for forming and assembling resistance system 200. In step 605, a retractable, multi-position coil 206 formed by inserting coiled cable 228 in plastic tubing housing 230. In step 610, resistive training harnesses 212, 218 are formed by coupling more than one extendable cable 213, 215, 227, 229 connected in parallel one each end and deattachably connected to retractable, multi-position coil 206 using one or more detachable connectors 217, 219. In step 615, resistance system 200 including multi-position coil 206 and resistive training harnesses 212, 218 tested for durability and form fit before shipment to customer.

While the above detailed description has shown, described, and pointed out as novel features of the invention as applied to various embodiments, it will be understood that those skilled in the art may make various omissions, substitutions, and changes in the form and details of the device or process illustrated without departing from the invention. The foregoing description includes a best mode presently contemplated of carrying out the invention. This description is in no way meant to be limiting, but rather should be taken as illustrative of the general principles of the invention.

We claim:

1. An athletic training apparatus to assist a coach training muscle coordination of a player during an exercise routine, the apparatus comprising:

an adjustable, delayed resistance, burst release, extension coil operatively coupled on a first coil end to a first end of a first cable harness and on a second coil end to a first end of a second cable harness;

wherein a second end of the first cable harness detachably couples to a coach and feedbacks real-time physical movements of the coach to the player;

wherein a second end of the second cable harness detachably couples to a training muscle group of the player, the training muscle group receives feedback from the real-time physical movements of the coach comprising a first resistance level during one portion of the exercise routine and a second resistance level during a second portion of the exercise routine;

wherein movements of the player are substantially unaffected or interfered with during the exercise routine; and wherein the adjustable, delayed resistance, burst release extension coil comprises an inner diameter cable and an outer diameter tube that are coupled together; wherein the inner diameter cable and an outer diameter tube uncoil to adjust a level of resistance that the player receives during the exercise routine; and wherein a diameter of the inner diameter cable and the outer diameter tube control the level of resistance applied to the training muscle group of the player.

2. The athletic training apparatus of claim 1, wherein a first portion of the exercise routine comprises the player commences motions to achieve a burst athletic position and the second portion of the exercise routine comprises the player completes motions of the burst athletic position.

3. The athletic training apparatus of claim 2, wherein the first and the second cable harness each comprises inner and outer tension cables that are crimped together to absorb shock to the training muscle group during a transitioning period between the first portion and the second portion of the exercise routine.

4. The athletic training apparatus of claim 1, wherein the first and the second cable harness each comprise two tension cables to absorb shock to the training muscle group of the player during a transition period between a first portion and the second portion of the exercise routine.

5. The athletic training apparatus of claim 4, wherein the second end of the second cable harness comprises a wishbone shape that attaches and conformal fits to a waist or lower abdomen region of the player to improve strength and endurance of the player while in real-time performing a change in direction of motion of the player from that of an initial direction.

6. The athletic training apparatus of claim 3, wherein the inner and the outer tension cables comprise at least one of two different tension resistance values and different outer diameter physical dimensions.

7. The athletic training apparatus of claim 1, wherein the adjustable, delayed resistance, burst release coil comprises an adjustable tension cable enclosed by a plastic coiled tube to absorb shock while the player is performing a first portion or the second portion of the exercise routine.

8. The athletic training apparatus of claim 1, wherein the first and the second cable harness comprise two bungee cords of varying, recoil tension coefficients that are coiled or crimped together and housed in a retractable nylon sleeve.

9. A system that provides real-time directed muscle coordination training by a coach for a player, the system comprising:

a burst release, multi-resistance cable operatively coupled on a first end to a first cable harness that couples to the coach and on a second end to a second cable harness that couples directly with one portion of a training muscle group of the player, the first cable harness feedbacks real-time physical movements of the coach to the player comprising a first resistance level during one portion of an exercise routine and a second resistance level during a second portion of the exercise routine;

wherein the burst release, multi-resistance cable comprises an inner diameter cable and an outer diameter tube that are coupled together; wherein the inner diameter cable and an outer diameter tube uncoil to adjust a level of resistance that the player receives during the exercise routine in accordance with inputs from the coach; and wherein a diameter of the inner diameter cable and the outer diameter tube control a range thereof and the level of resistance applied to the training muscle group of the player;

wherein freedom of movement of the training muscle group of the player throughout an entirety of the exercise routine remains substantially true to form.

10. The system of claim 9, wherein a first portion of the exercise routine comprises the player positions toward a burst athletic position and the second portion of the exercise routine comprises the player completes the burst athletic position.

11. The system of claim 10, wherein the first and the second cable harness each comprises an inner elastic tension cable and an outer elastic tension cable that are crimped together to absorb shock or jerking motion to the training muscle group during a transition period between start of the first portion and completion of the second portion of the exercise routine.

12. The system of claim 9, wherein the first and the second cable harness each comprise two tension cables cooperatively coupled to each other to absorb shock or jerking motion to the muscle group of the player during a transition period between a first portion and the second portion of the exercise routine.

13. The system of claim 9, wherein the second cable harness couples that directly to the training muscle group comprises a deattachably coupled wishbone shaped harness that conforms to a waist line or lower abdomen region of the player and improves off-the-line strength and endurance of the player while performing a real-time exercise movement during the exercise routine whether or not a player changes direction or orientation of motion from that of start of a first portion of the exercise routine to that of completion of the second portion of the exercise routine.

14. The system of claim 12, wherein the two tension cables comprise two different tension resistance values and different outer diameter physical dimensions.

15. The system of claim 9, wherein the burst release, multi-resistance coil comprises an adjustable tension cable enclosed by a plastic coiled tube to absorb shock while the player is performing a first portion or the second portion of the exercise routine; and wherein the first and the second cable harness comprise two bungee cords of varying, recoil tension coefficients that are coiled or crimped together.

16. The system of claim 9, wherein a burst release, multi-resistance cable comprises an adjustable, delayed resistance, burst release, extension coil.

* * * * *